US005572778A

United States Patent [19]

Stenner et al.

[11] Patent Number: 5,572,778

[45] Date of Patent: Nov. 12, 1996

[54] SHOELACE SECURING METHOD

[76] Inventors: John R. Stenner, deceased, late of Greeley, Colo.; by Richard H. Stenner, heir; Doreen A. Stenner, heir, both of 2522 56th Ave., Greeley, Colo. 80634

[21] Appl. No.: 274,818

[22] Filed: Jul. 14, 1994

[51] Int. Cl.[6] ..... A43C 7/00

[52] U.S. Cl. ..... 24/712.9; 24/712.7; 36/50.1

[58] Field of Search ..... 24/712.1, 712.5, 24/712.9, 712.7, 129 D; 36/50.1, 136

[56] References Cited

U.S. PATENT DOCUMENTS

| | | | |
|---|---|---|---|
| 131,593 | 9/1872 | Bowers . | |
| 509,707 | 11/1893 | Vachon | 24/712.1 |
| 670,965 | 4/1901 | Myers | 24/712.5 |
| 1,806,162 | 5/1931 | Hahn . | |
| 1,879,475 | 9/1932 | Poon | 24/712.9 |
| 2,292,140 | 8/1942 | Lofgren . | |
| 3,358,338 | 12/1967 | Clasen | 24/712.9 |
| 5,065,482 | 11/1991 | Lofy | 24/712.1 |
| 5,119,539 | 6/1992 | Curry | 24/712.9 X |
| 5,182,838 | 2/1993 | Stenner | 24/129 D X |

FOREIGN PATENT DOCUMENTS

| | | | |
|---|---|---|---|
| 265924 | 8/1963 | Australia . | |
| 192804 | 12/1956 | Austria | 24/712.1 |
| 731056 | 2/1943 | Germany . | |
| 688260 | 3/1953 | United Kingdom . | |

*Primary Examiner*—James R. Brittain
*Attorney, Agent, or Firm*—John R. Flanagan

[57] ABSTRACT

A shoelace securing method includes, initially, threading the free end portions of a pair of shoelaces, emanating from a tightly laced region on the shoe, upwardly through a main passageway formed in a securing device by passing the free end portions into an open bottom end and out of an open top end of the passageway of the securing device, next, routing the free end portions of the pair of shoelaces from the open top end of the passageway of the securing device forwardly to and downwardly through an auxiliary passageway formed in a forward edge portion of the securing device, and, finally, tightly wrapping the free end portions of the pair of shoelaces around the shoelaces adjacent to the open bottom end of the main passageway of the securing device between a bottom side of the securing device and the tightly laced region of the shoe.

12 Claims, 1 Drawing Sheet

SHOELACE SECURING METHOD

TECHNICAL FIELD

The present invention generally relates to alternative ways of securing shoelaces without tying knots and, more particularly, is concerned with a shoelace securing method.

BACKGROUND ART

Shoelaces have traditionally been used to secure a shoe to a person's foot. To maintained the shoe in the secured condition on the person's foot, loosening of the shoelaces is typically restricted by the conventional method of tying a knot in the shoelaces.

Tying knots, however, can be a troublesome, time-consuming process, especially if the shoelaces are small or the person has limited finger dexterity. Also, difficulty is frequently experienced in achieving proper tension when tying shoelaces. For example, in the conventional method of tying a knot in shoelaces, the person must relax the tension on the shoelaces after pulling them tight in order to tie the knot. This provides an opportunity for the shoelaces to loosen up before the knot tying is completed. This can be a real problem with athletic shoes, especially court shoes, where tight lace tension is essential to proper shoe performance and the prevention of foot and ankle injuries.

Furthermore, the convetnional knot tying method does not allow lace tension to be easily adjusted. For example, the material of the shoe stretches and becomes more pliable when it warms up and stress is applied to it from foot movement. This causes the shoe to loosen up on the foot even though the shoelaces have not been loosened. To compensate for the shoe loosening, the wearer has to periodically untie the shoelaces, tighten the shoelaces and then retie the shoelaces. This is an onerous task, especially if a double knot was used as is often done in athletic shoe applications.

Various devices have been developed in the past to alleviate the problems associated with the conventional method of tying cords, such as shoelaces. The devices for securing cords can be classified into two types: mechanical devices and unitary devices. Mechanical devices require several parts to interact to create the cord locking effect of the device. This type of device incurs additional manufacturing expense due to the need for multiple parts and their assembly, and such devices are prone to wear and failure because of the interaction of their parts. Furthermore, the most popular commercial cord locks of this type are not very effective at securing cords in a lasting manner. For example, the shoelaces of a shoe will slowly slip through the device as the shoe is being used which allows the shoe to become loose.

The second type, unitary devices, are fabricated in one piece with one material which is usually a resilient plastic. The locking effect is the result of the device's physical configuration and material properties working together. Such inventions have been developed for applications ranging from cord locks and clips, to implement holders for safety helmets.

One such integral cord lock device which has demonstrated superior ability to grip and hold shoelaces is disclosed in U.S. Pat. No. 5,182,838 to John R. Stenner, the applicant of the subject application. The patented cord lock device has a body of resilient material and a slit through the center thereof that defines two cord opposing gripping surfaces. The cords or laces threaded through the slit are securely engaged by a clamping effect at the slit and surface friction between the cords and the gripping surfaces of the slit. The clamping effect results from pressure being applied to the base of the cord lock device by the shoe to which the cords are attached. One releases the cords by squeezing with the fingers the exterior sides of the cord lock body, being perpendicular to the slit. This causes the slit to pucher and thus spread open the slit walls.

The aforementioned patented cord lock device is capable of securely locking one, two, or more cords, is flexible and very easy to use. The patented cord lock device also allows shoes to be quickly secured and then adjusted while in use and will not allow cords to slip during use. The patented cord lock device further is of integral construction which minimizes production costs and is durable due to the absence of hinges or joints thus minimizing wear points.

While the patented cord lock device firmly retains the necessary tension on the shoelaces, it does fail to control the portions of the shoelaces which extend from the device. These portions can easily catch on various different objects encountered along the path of movement of the user and stepped on by the other foot and thereby hinder the unimpeded movement of the user from place to place.

Consequently, a need exists to find a way to restrain free movement of the free end portions of the shoelaces that protrude from the top of the device.

DISCLOSURE OF INVENTION

The present invention provides to a shoelace securing method designed to satisfy the aforementioned needs. The shoelace securing method achieves the securement of free end portions of shoelaces of a shoe by shortening the lengths of such portions which extend and hang freely and thereby reduce the opportunity for such portions to catch on adjacent objects or to be stepped on by the other foot.

Accordingly, the present invention is directed to a shoelace securing method comprising the basic steps of: (a) threading the free end portions of a pair of shoelaces emanating from a tightly laced region on the shoe upwardly through a main passageway of a main slit formed in a securing device by passing the free end portions into an open bottom end and out of an open top end of the main passageway; (b) routing the free end portions of the pair of shoelaces from the open top end of the main passageway of the securing device forwardly to and downwardly through an auxiliary passageway of an auxiliary slit formed in a forward edge portion of the securing device; and (c) tightly wrapping the free end portions of the pair of shoelaces around the pair of shoelaces adjacent to the open bottom end of the main passageway of the securing device between a bottom side of the securing device and the tightly laced region of the shoe.

More particularly, after the free end portions of the shoelaces are threaded through the main passageway of the securing device and while holding the free end portions of the pair of shoelaces in a taut condition, the securing device is slid downwardly on the free end portions against tightly laced region on said shoe. Also, the free end portions of the shoelaces are rounted from the main passageway to and through the auxiliary passageway and then tightly wrapped around the pair of shoelaces below the securing device while the securing device is held against the laced region on the shoe.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

BEST MODE FOR CARRYING OUT THE INVENTION

Figure 1:
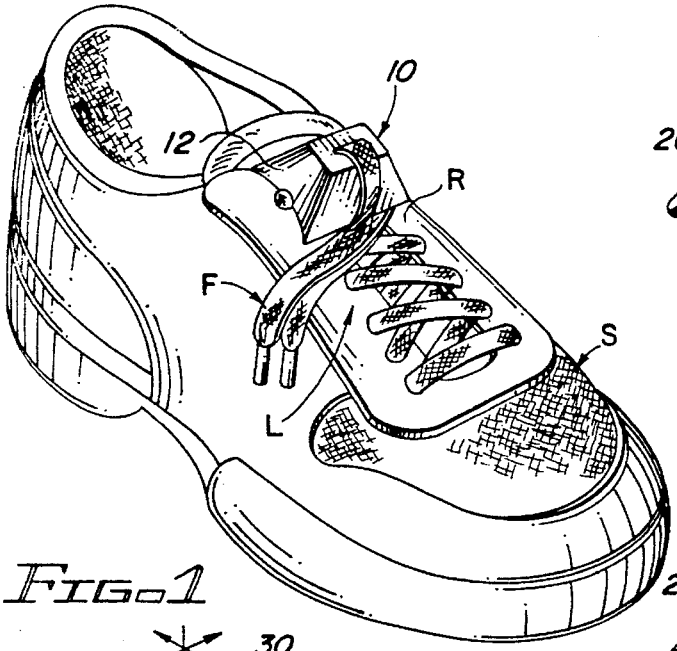
FIG. 1 is a top perspective view showing shoelaces on a shoe secured thereto by application of the shoelace securing method of the present invention.

Referring to the drawings and particularly to FIG. 1, there is illustrated a shoe S tied with a pair of shoelaces L being secured at their free end portions F by application of the shoelace securing method of the present invention. The application of the shoelace securing method results not only in the shoelaces L being secured but also in the lengths of their free end portions F being substantially shorten so that reduced lengths of such portions will hang freely and thereby reduce the opportunity for such portions E to catch on adjacent objects or be stepped on by the other shoe.

Referring to FIGS. 1 to 5, there is illustrated a securing device, generally designated 10, which is employed in the shoelace securing method of the present invention. The securing device 10 incorporates the features of the cord lock device shown and described in the aforesaid U.S. Pat. No. 5,182,838, the disclosure of which is hereby incorporated herein by reference. In addition thereto, the securing device 10 incorporates several other features, not incorporated in the patented cord lock device, that are instrumental in using the device 10 to achieve securement of the shoelaces L. While the cord lock device of the aforesaid patent with the other features which will be described later on, is illustrated as the device being used herein to implement the shoelace securing method of the present invention, it should be understood that the securing method is not considered to be limited to use of this specific cord lock device. Other devices having features similar to certain of the features of this one specific device could be utilized to perform the shoelace securing method of the present invention.

Referring to FIGS. 2 to 5, the illustrated securing device 10 basically includes a body 12 formed of an elastic resilient material and having a substantially solid interior. The body 12 of the securing device 10 also has a pair of generally opposite top and bottom exterior surface portions 14, 16, a pair of generally opposite front and rear side exterior surface portions 18, 20, and a pair of generally opposite right and left end exterior surface portions 22, 24. In the illustrated example of the securing device 10, these respective pairs of surface portions of the body 12 are formed so as to provide the body 12 in a pyramidal shape with a flat top, although the body 12 can equally be made in other shapes.

The body 12 of the securing device 10 further has a generally planar main narrow slit 26 formed in and extending through the substantially solid interior of the body 12 between the opposite top and bottom exterior surface portions 14, 16 thereof to form a main narrow passageway for receiving the shoelaces L through the body 12. The main slit 26 is defined by a pair of opposing interior right and left end walls 28, 30 spaced inwardly from the opposite right and left end exterior surface portions of the body 12 and a pair of opposing interior front and rear side walls 32, 34 spaced inwardly from the opposite front and rear side exterior surface portions of the body 12. The opposing interior right and left end walls 28, 30 and the interior front and rear side walls 32, 34 extend between the opposite top and bottom exterior surface portions 14, 16 of the body 12 and the opposing interior right and left end walls 28, 30 extend between and interconnect respective opposite ends of the opposing interior front and rear side walls 32, 34 such that the substantially solid interior of the body 12 completely surrounds the main passageway defined by the main slit 26, with the shoelaces L received therethrough by extending into the main slit 26 at the bottom exterior surface portion 16 and from the main slit 26 at the top exterior surface portion 14 of the body 12.

Further, the opposing interior front and rear side walls 32, 34 of the main slit 26 form gripping surfaces therein being capable of engaging and gripping and thereby securely holding the portions of the shoelaces L extending through the main passageway defined by the slit 26. Approximately halfway down the interior of the body 12, the interior front and rear side walls 32, 34 of the main slit 26 diverge forming a bottom hollow cavity 36 with a large opening 36A in the bottom exterior surface portion 16 of the body 12. Also, a pair of opposing right and left bottom channels 38, 40 are formed into the bottom exterior surface portion 16 at opposite ends of the bottom hollow cavity 36 and midway along the lower edges of the right and left end exterior surface portions 22, 24. The right and left bottom channels 38, 40 are aligned with the bottom hollow cavity 36 and together therewith provide passages for the smooth transition of the shoelaces S from the top of the shoe into the bottom of the main slit 26.

The opposing interior front and rear side walls 32, 34 of the main slit 26 have respective widths extending between the opposing interior right and left end walls 28, 30 of the main slit 26 that are substantially longer than respective widths of the opposing interior right and left end walls 28, 30 of the main slit 26 extending between the opposing interior front and rear side walls 32, 34 of the main slit 26. Therefore, the application of inwardly directed pressure at the opposite right and left end exterior surface portions 22, 24 of the body 12 will cause the opposing interior right and left end walls 28, 30 of the main slit 26 to move toward one another and the opposing interior front and rear side walls 32, 34 of the main slit 26 to move away from one another to thereby cause the main slit 26 to deform from a substantially closed unpuckered configuration in which the gripping surfaces on the opposing interior front and rear side walls 32, 34 securely hold the shoelaces L, to a substantially opened puckered configuration in which the shoelaces L, being held securely by the gripping surfaces, are released for permitting moving of the body 12 relative to the shoelaces L.

Figure 3:
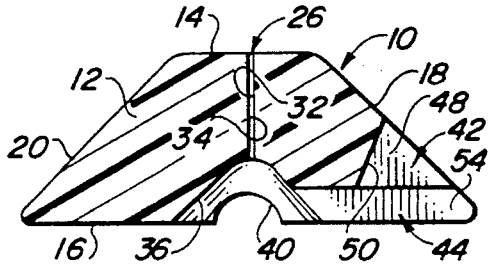
FIG. 3 is an enlarged longitudinal sectional view of the shoelace securing device taken along line 3—3 of FIG. 2
Figure 4:
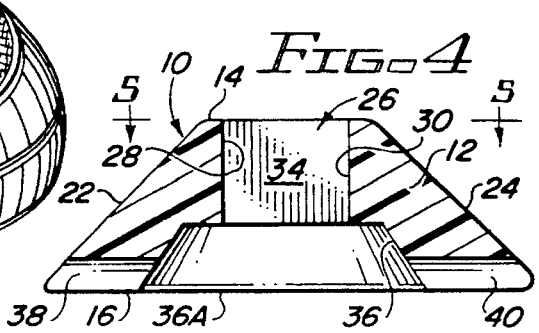
FIG. 4 is an enlarged transverse sectional view of the shoelace securing device taken along line 4—4 of FIG. 2.
Figure 2:
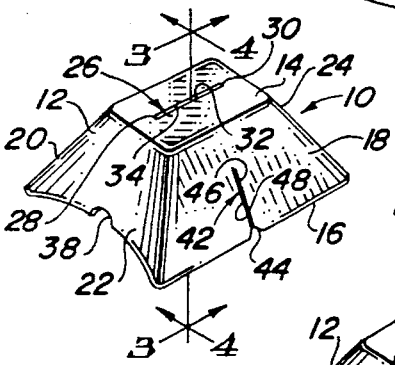
FIG. 2 is a perspective view of a shoelace securing device employed by the shoelace securing method of the present invention.

Referring again to FIGS. 2 to 5, as mentioned earlier the securing device 10 also has several other features which are instrumental in the carrying out of the shoelace securing method of the present invention. These other features include an auxiliary slit 42 and a notch 44 which leads into the auxiliary slit 42. The auxiliary slit 42 is defined in the solid interior of the body 12 extending inwardly into the solid interior of the body 12 from the bottom exterior surface portion 16 and the front side exterior surface portion 18 thereof. As best seen in FIG. 3, the auxiliary slit 42 is formed by a pair of opposing wall surfaces 46, 48 being generally triangular in shape which extend inwardly to an inner narrow end surface 50 which connects between the opposing wall surfaces 46, 48 within the solid body 12. The notch 44 is formed by a pair of elongated narrow surfaces 52, 54 which extend between the lower edges of the opposing wall surfaces 46, 48 of the auxiliary slit 42 and the bottom exterior surface portion 16 of the body 12.

Figure 6A:
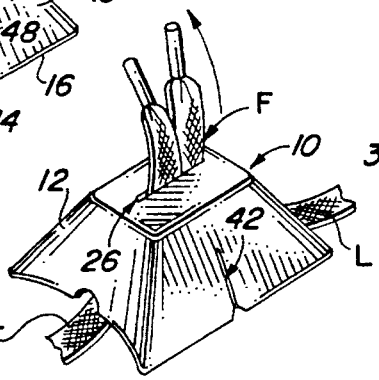
FIGS. 6A to 6D are a sequence of perspective, sectional, and top plan views illustrating the steps of the shoelace securing method of the present invention.
Figure 5:
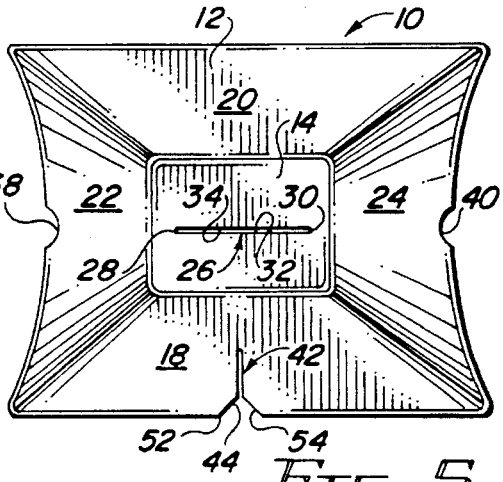
FIG 5 is an enlarged top plan view of the shoelace securing device as seen along line 5—5 of FIG. 4.

To apply the securing device 10 merely to grip and hold the shoelaces L, the same steps as described in the aforesaid patent are used herein. First, as seen in FIG. 6A, the free end portions F of the shoelaces L emanating from a tightly laced region R on the shoe S are threaded upwardly through the main passageway formed by the main slit 26 in the body 12 of the securing device 10. The free end portions F are passed into the open bottom end and out of the open top end of the main passageway formed by the main slit 26 of the body 12. The threading occurs after the shoe S has already been tightened on the foot using the shoelaces L. Next, the shoelace free end portions E are grasped and held taut by one hand to prevent the shoe from loosening up, while the thumb and forefinger of the other hand are placed on the front and rear exterior side walls 22, 24 of the body 12 of the securing device 10. The body 12 is then slidably pushed down the shoelaces L toward the shoe S with the other hand while the one hand keeps the shoelaces L in tension to prevent the shoe from loosening and to facilitate pushing of the body 12 towards the shoe such that it easily slides down the shoelaces L until the bottom exterior surface portion 16 of the body 12 is pressed firmly against the top of the shoe S.

Figure 6B:
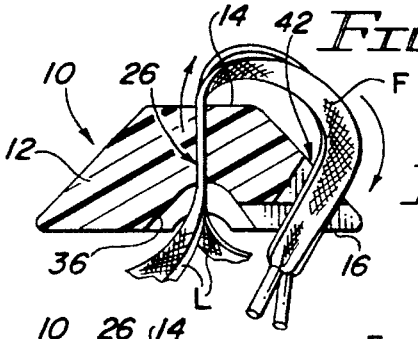
Figure 6C:
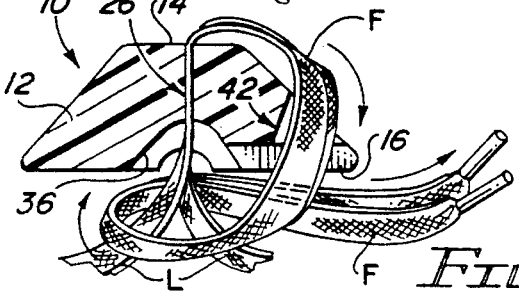
Figure 6D:
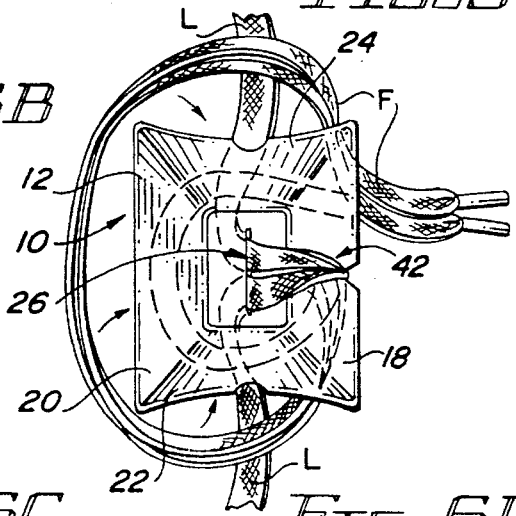

Referring to FIGS. 6B to 6D, there are illustated the successive steps, in addition to the initial step described above, which are employed by the shoelace securing method of the present invention which culminate in the secured condition of the shoelaces, as seen in FIG. 1. FIG. 6B shows the next step of routing the free end portions F of the pair of shoelaces S from the open top end of the main passageway formed by the main slit 26 in the body 12 of the securing device 10 forwardly to and downwardly through the auxiliary passageway formed by the auxiliary slit 42 in a forward edge portion of the body 12 of the securing device 10. This step is carried out while holding the securing device 10 against the tightly laced region R on the shoe S. FIGS. 6C and 6D show the final step of tightly wrapping the free end portions F of the shoelaces L around the shoelaces L adjacent to the open bottom end of the main passageway of the securing device 10 between the bottom exterior surface portion 16 of the body 12 of the securing device and the tightly laced region R of the shoe S (shown in FIG. 1 only).

It is thought that the present invention and its many advantages will be understood from the foregoing description and it will be apparent that various changes may be made thereto without departing from the spirit and scope of the invention or sacrificing all of its material advantages, the form hereinbefore described being merely a preferred or exemplary embodiment thereof.

It is claimed:

1. A shoelace securing method, comprising the steps of:

(a) threading free end portions of a pair of shoelaces emanating from a tightly laced region on a shoe upwardly through a main passageway formed in a securing device by passing into an open bottom end and out of an open top end of the main passageway of the securing device;

(b) routing said free end portions of said pair of shoelaces from said open top end of said main passageway of said securing device forwardly to and downwardly through an auxiliary passageway formed in a forward edge portion of said securing device; and (c) tightly wrapping said free end portions of said pair of shoelaces around said pair of shoelaces adjacent to said open bottom end of said main passageway of said securing device between a bottom side of said securing device and said tightly laced region of said shoe.

2. The method of claim 1 wherein, while holding said free end portions of said pair of shoelaces in a taut condition, sliding said securing device downwardly on said free end portions of said pair of shoelaces against said tightly laced region on said shoe.

3. The method of claim 1 further comprising:

providing a main narrow slit in a solid body forming said securing device, said main narrow slit having a pair of opposing gripping surfaces defining said main passageway.

4. The method of claim 3 wherein said threading of said free end portions of said pair of shoelaces includes extending said free end portions upwardly from said tightly laced region on said shoe through said main narrow slit in said solid body of said securing device.

5. The method of claim 3 further comprising:

providing an auxiliary narrow slit in said solid body forming said securing device, said auxiliary narrow slit having a pair of opposing gripping surfaces defining said auxiliary passageway and being disposed in a tranverse orientation to said main narrow slit.

6. The method of claim 5 wherein, while holding said securing device against said laced region on said shoe, routing said free end portions of said pair of shoelaces from said main narrow slit forwardly to and downwardly through said auxiliary narrow slit in said body of the securing device.

7. A shoelace securing method, comprising the steps of:

(a) providing a securing device having a solid body, a main narrow passageway defined through said body extending vertically between and open at upper and lower portions thereof, and an auxiliary narrow passageway defined through a front edge portion of said body extending vertically between and open at said upper and lower portions thereof and in a tranverse orientation to said main narrow passageway and being spaced forwardly of said main narrow passageway;

(b) routing free end portions of a pair of shoelaces emanating upwardly from said main narrow passageway at said upper portion of said body of said securing device forwardly to and downwardly through said auxiliary narrow passageway to below said lower portion of said body of said securing device; and (c) tightly wrapping said free end portions of said pair of shoelaces around said pair of shoelaces extending between said lower portion of said body of said securing device and a tightly laced region of said shoe.

8. The method of claim 7 wherein said main narrow passageway is provided by forming a main narrow slit in said solid body.

9. The method of claim 8 wherein said auxiliary narrow passageway is provided by forming an auxiliary narrow slit in said solid body.

10. The method of claim 8 wherein said routing of said free end portions of said pair of shoelaces includes extending said free end portions upwardly from said tightly laced region on said shoe through said main narrow slit in said solid body of said securing device.

11. The method of claim 8 wherein, while holding said free end portions of said pair of shoelaces in a taut condition, sliding said securing device downwardly on said free end portions of said pair of shoelaces against said tightly laced region on said shoe.

12. The method of claim 8 wherein, while holding said securing device against said laced region on said shoe, routing said free end portions of said pair of shoelaces from said main narrow slit forwardly to and downwardly through said auxiliary narrow slit in said body of the securing device.

* * * * *